US008262078B2

(12) United States Patent
Shibuya

(10) Patent No.: US 8,262,078 B2
(45) Date of Patent: Sep. 11, 2012

(54) IMAGE-FORMING APPARATUS AND CONTROL METHOD THEREOF

(75) Inventor: Yuichiro Shibuya, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/070,162

(22) Filed: Mar. 23, 2011

(65) Prior Publication Data

US 2011/0170126 A1 Jul. 14, 2011

Related U.S. Application Data

(63) Continuation of application No. 12/041,351, filed on Mar. 3, 2008, now Pat. No. 7,931,264.

(30) Foreign Application Priority Data

Mar. 14, 2007 (JP) ..... 2007-065779

(51) Int. Cl.
*B65H 3/44* (2006.01)

(52) U.S. Cl. ..... 271/9.02; 271/9.05

(58) Field of Classification Search ..... 271/9.02, 271/9.05

See application file for complete search history.

(56) References Cited

U.S. PATENT DOCUMENTS 6,176,481 B1 * 1/2001 Ohkoda ..... 271/9.05
2002/0063881 A1 * 5/2002 Nakata et al. ..... 358/1.14

FOREIGN PATENT DOCUMENTS

JP 2002-190887 A 7/2002
JP 2005-298102 A 10/2005
JP 2008-056368 A 3/2008

OTHER PUBLICATIONS

The above references were cited in a Aug. 12, 2011 Chinese Office Action, with an English Translation, that issued in Chinese Patent Application No. 200810085386.5.

* cited by examiner

*Primary Examiner* — Michael McCullough
*Assistant Examiner* — Howard Sanders
(74) *Attorney, Agent, or Firm* — Cowan, Liebowitz & Latman, P.C.

(57) ABSTRACT

In a case that it is determined that a first feeding unit is not ready to feed upon designation of a first print job that requires air feeding, start of the first print job is waited until the first feeding unit is ready to feed. In a case that a second print job that requires roll feeding is accepted during waiting for the first print job, the second print job is executed, and the first print job that requires air feeding is executed after completion of the second print job.

9 Claims, 12 Drawing Sheets

IMAGE-FORMING APPARATUS AND CONTROL METHOD THEREOF

CROSS-REFERENCE TO RELATED APPLICATIONS

This application is continuation of application Ser. No. 12/041,351, filed Mar. 3, 2008, now U.S Pat. No. 7,931,264 the entire disclosures of which is hereby incorporated by reference.

BACKGROUND OF THE INVENTION

1. Field of the Invention

The present invention relates to an image-forming apparatus and control method thereof and, more particularly, to an image-forming apparatus which comprises a plurality of sheet feed units and a control method thereof.

2. Description of the Related Art

An image-forming apparatus such as a copying machine, printer, facsimile apparatus, or the like has a sheet container (sheet feeding tray) which stores sheets, and transfers a sheet from the sheet container to an image-forming unit using a sheet supply unit. The image-forming unit forms an image on the sheet which is transferred in this way, and discharges the sheet on which the image is formed outside the apparatus. A sheet supply unit of roller type which transfers a sheet downstream by rotation of sheet feed rollers is generally used as the sheet supply unit in such image-forming apparatus. In this sheet supply unit of roller type, the surface of each roller is made up of an elastic member such as rubber or the like, and its sheet supply performance largely depends on the friction coefficient of the roller surface. Therefore, the sheet supply performance is not stable due to a change in outer shape of each roller, aging of the material of each roller, and a change in friction coefficient of the roller surface due to attachment of paper powder and the like. The sheet supply unit of roller type cannot support high-speed feeding and various sheets with different surface conditions.

In order to solve these problems, Japanese Patent Laid-Open No. 6-199437 has proposed an air feeding apparatus which adopts an air separation system. This air feeding apparatus comprises handling means for handling upper sheets by blowing air to the end portion of sheets stacked in a sheet stack unit, and absorptive transfer means for absorbing and transferring an uppermost sheet onto a conveyor belt.

A conventional image-forming apparatus has a plurality of sheet containers so as to form images on various types of sheets, and can store sheets of various sizes for respective sheet containers. Also, by storing sheets of an identical size in the plurality of sheet supply units, an image-forming apparatus which stores sheets in large quantities in itself and can form images in large quantities is currently popular.

When the image-forming apparatus having the plurality of sheet feeding trays uses air feeding apparatuses, the following problems are posed.

The air feeding apparatus equipped in each sheet feed unit has means for handling upper sheets by blowing air to the end portion of a bundle of sheets, and means for absorbing an uppermost sheet on a transfer belt, and these means use a pneumatic pressure. Upon using a pneumatic pressure, a time delay is produced until the pneumatic pressure acts on sheets in each sheet feeding tray even by extracting/suctioning air so as to attain feeding. Causes of such delay include the duct length, the switching time of an on-off valve in the duct used to switch air for each sheet feed unit, a delay of a handling time due to the weight of sheets, and the like. In this way, the air feeding apparatus suffers a low throughput of jobs due to a time delay until the pneumatic pressure acts on sheets even upon starting feeding.

Japanese Patent Laid-Open No. 2002-40881 describes a technique that checks if sheet containers other than that which has caused an "out of paper" error store sheets with an identical size, and continues to feed sheets from the sheet container without stopping the feeding operation if such sheet container is found. With this function, the operation stop time due to the "out of paper" error is shortened, and print job efficiency is enhanced.

Japanese Patent Laid-Open No. 5-286590 has proposed an air feeding apparatus which removes an exchange delay time of sheet feed unit by applying air to two feeding apparatuses all the time. In this Japanese Patent Laid-Open No. 5-286590, one air extraction device and air supply device distribute extracted air and supply air to a plurality of trays. By setting a pressure that allows feeding upon opening on-off valves of two trays, on-off control means executes valve control to always open the two on-off valves. With this control, since the two on-off valves are always open, no or little pneumatic pressure variation occurs even when sheets are fed from both of the two trays. Thus, upon exchange of sheet feed units, the pneumatic pressure on the tray side can be quickly changed to a value required for the operation. In this manner, an air feeding apparatus which can prevent the throughput of print jobs from lowering by eliminating any exchange loss of sheet feed units has been proposed.

As described above, air feeding can meet a higher-speed image-forming apparatus compared to roll feeding. However, since air feeding requires much time until it becomes ready to attain air feeding, a time required until first printing (the first print output after the image-forming apparatus accepts a job execution instruction) is prolonged.

SUMMARY OF THE INVENTION

It is an object of the present invention to eliminate the above-described problems of the conventional technology.

An advantage of the present invention is to execute a print job at high speed while shortening a time required from reception of a print job until execution of printing in an image-forming apparatus that allows both roll feeding and air feeding.

According to a first aspect of the present invention, there is provided an image-forming apparatus comprising:

a first feeding unit configured to perform sheet feeding from a source using air;

a second feeding unit configured to perform sheet feeding from a source of sheets using a roller;

an acceptance unit configured to accept a first print job which requires feeding from the first feeding unit and a second print job which requires feeding from the second feeding unit;

a determination unit configured to determine a state of in the first feeding unit;

a delay unit operable, in a case that the determination unit determines that the first feeding unit is not ready to feed sheets, to delay start of the first print job; and a control unit operable, in a case that the second print job is accepted while the start of the first print job is delayed by the delay unit, to execute the second print job while the first print job is delayed.

According to another aspect of the present invention, there is provided a method of controlling an image-forming apparatus which comprises a first feeding unit for performing sheet feeding from a source of sheets using air, and a second feeding unit for performing sheet feeding from a source of sheets using a roller, comprising the steps of:

accepting a first print job which requires feeding from the first feeding unit, and a second print job which requires feeding from the second feeding unit;

determining a state of in the first feeding unit;

delaying, in a case that it is determined in the determining step that the first feeding unit is not ready to feed sheets, execution of the first print job; and in a case that the second print job is accepted while the start of the first print job is delayed in the delaying step, executing the second print job while the first print is delayed.

Further features of the present invention will become apparent from the following description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE EMBODIMENTS

Numerous embodiments of the present invention will now herein be described below in detail with reference to the accompanying drawings. The following embodiments are not intended to limit the claims of the present invention, and not all combinations of features described in the embodiments are essential to the solving means of the present invention.

Figure 1:
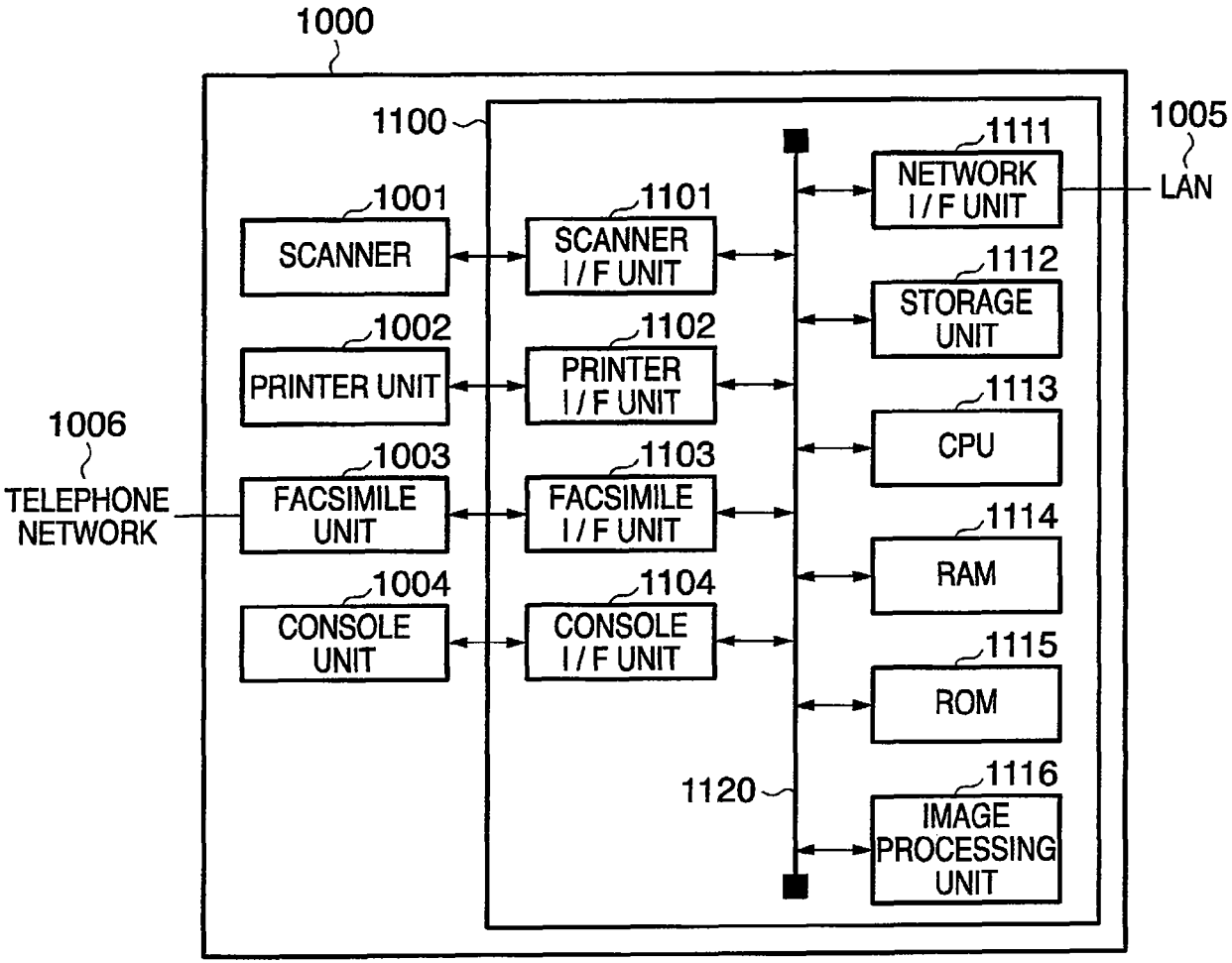
FIG. 1 is a block diagram showing the arrangement of a digital multi function peripheral (MFP) according to an exemplary embodiment of the present invention.

FIG. 1 is a block diagram showing the arrangement of a digital multi function peripheral (MFP) 1000 as an example of an image-forming apparatus according to an embodiment of the present invention.

In this MFP 1000, a scanner 1001, printer unit 1002, facsimile unit 1003, and console unit 1004 are connected to a controller 1100. The console unit 1004 has a display unit used to display warnings and messages to the user, and various keys, switches, and the like to be operated by the user. The MFP 1000 is connected to a LAN 1005 via a network interface (I/F) unit 1111, and a telephone network 1006 is connected to the facsimile unit 1003.

The arrangement of the controller 1100 will be described below. A CPU 1113 is connected to a system bus 1120. The CPU 1113 is connected, via this bus 1120, to a scanner I/F unit 1101, a printer I/F unit 1102, a facsimile I/F unit 1103, a console I/F unit 1104, and the network I/F unit 1111. The CPU 1113 is also connected to a storage unit 1112, RAM 1114, ROM 1115, and image-processing unit 1116. The operations of the respective units will be described below based on the flows of signals among these units.

Image data supplied from the scanner 1001 undergoes image processing in the image-processing unit 1116 via the scanner I/F unit 1101, and is stored in the RAM 1114. A control command issued by the scanner 1001 is transferred to the CPU 1113. Print data received via the LAN 1005 is rasterized by the image-processing unit 1116 via the network I/F unit 1111, and is transferred to and stored in the RAM 1114. A control command received by the network I/F unit 1111 is transferred to the CPU 1113. Facsimile data received via the telephone network 1006 is transferred to the RAM 1114 via the facsimile unit 1003. A control command supplied from the facsimile unit 1003 is transferred to the CPU 1113.

These image data stored in the RAM 1114 undergo image processing such as rotation processing, zoom processing, and the like of images by the image-processing unit 1116 under the control of the CPU 1113. After that, the image data are sent to the printer unit 1002 via the printer I/F unit 1102 or are transmitted onto the telephone network 1006 via the facsimile unit 1003.

Upon reception of a display request onto the console unit 1004 from the scanner I/F unit 1101 or the facsimile unit 1003, the CPU 1113 displays the designated display contents on the display unit of the console unit 1004. Furthermore, when the user makes a key operation on the console unit 1004, that operation information is supplied to the CPU 1113 via the console I/F unit 1104. The CPU 1113 determines based on the contents of the key operation whether the operation information received from the console I/F unit 1104 is transferred to the scanner I/F unit 1101 or facsimile unit 1003. Also, the CPU 1113 executes input/output control of image data based on the operation information. The network I/F unit 1111 can transmit and receive data in accordance with communication protocols.

A control program of the CPU 1113 which executes such control is stored in the ROM 1115, and the CPU 1113 operates based on the control program stored in the ROM 1115. Note that the RAM 1114 is used as a work area when the CPU 1113 executes various kinds of control processing.

Figure 2:
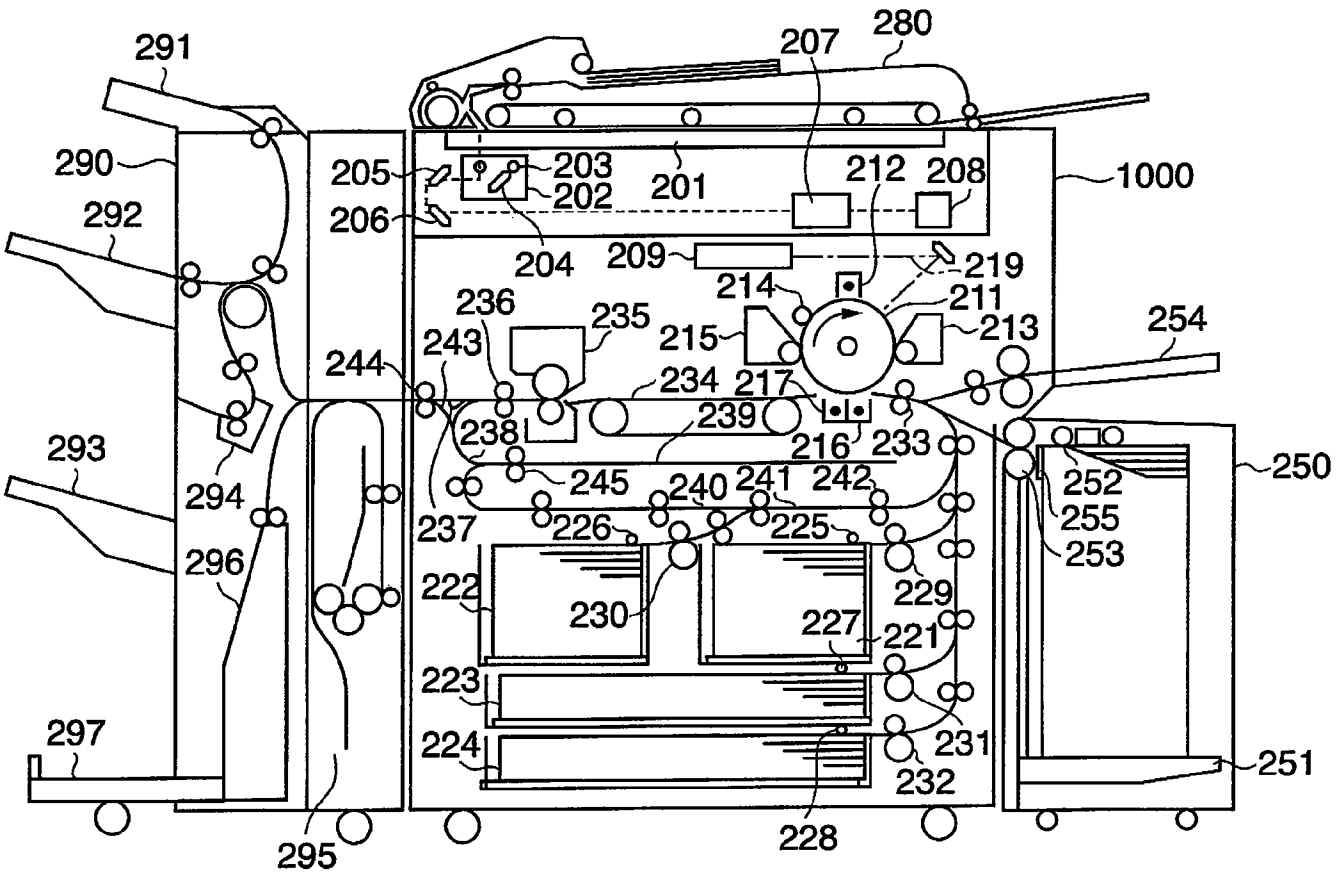
FIG. 2 depicts a schematic sectional view explaining the structure of the digital MFP according to the embodiment of the present invention.

FIG. 2 depicts a schematic sectional view explaining the structure of the digital MFP 1000 according to this embodiment.

An auto document feeder (ADF) 280 is equipped on the upper portion of this digital MFP 1000. A platen glass 201 is used to place a document to be scanned. A scanner unit 202 has a lamp for lighting 203, mirror 204, and the like, and is reciprocally scanned in predetermined directions by rotation of a motor (not shown). Light reflected from a document irradiated with light from this scanner unit 202 is transmitted through a lens 207 via mirrors 204 to 206 and forms an image on an image sensor 208 (CCD sensor).

An exposure controller 209 has a laser, polygon scanner, and the like, and irradiates a photosensitive drum 211 with a laser beam 219, which is modulated based on an image signal obtained by applying the image processing to an electrical signal supplied from the image sensor 208 by the image-processing unit 1116. Around this photosensitive drum 211, a primary charger 212, developer 213, transfer charger 216, pre-exposure lamp 214, and cleaning unit 215 are equipped.

The photosensitive drum 211 rotates in the direction of an arrow shown in FIG. 2 upon rotation of a motor (not shown). After the surface of the photosensitive drum 211 is charged to a desired potential by the primary charger 212, it is irradiated with the laser beam 219 from the exposure controller 209 to form an electrostatic latent image. The electrostatic latent image formed on the photosensitive drum 211 is developed by the developer 213 to be visualized as a toner image.

On the other hand, sheets (which term includes sheets of materials other than paper like OHP sheets) stored in a right cassette deck 221, left cassette deck 222, upper cassette 223, or lower cassette 224 are picked up upon rotation of a pickup roller 225, 226, 227, or 228. The picked-up sheet is transferred into the main body upon rotation of sheet feed roller 229, 230, 231, or 232. The sheet transferred into the main body is fed onto a transfer belt 234 by registration rollers 233. After that, the toner image visualized on the photosensitive drum 211 is transferred onto the sheet by the transfer charger 216. The surface of the photosensitive drum 211 after the toner image is transferred is cleaned by the cleaning unit 215, and the residual charge is cleared by the pre-exposure lamp 214.

The sheet on which the toner image is transferred is separated from the photosensitive drum 211 by a separation charger 217, and is fed to a fixing unit 235 by the transfer belt 234. The fixing unit 235 fixes the toner image on the sheet by applying a pressure and heat. The sheet on which the toner image is fixed is discharged outside the main body upon rotation of discharge rollers 236.

This MFP 1000 equips a deck 250 that can store, e.g., 4000 sheets. This deck 250 adopts a so-called air separation system, and is of a type that separates and feeds in turn from an uppermost sheet. A lifter 251 of the deck 250 moves upward according to the amount of sheets. The sheets are handled one by one by air blowing out from a blow-out duct 255. Then, an upper sheet is absorbed by an absorbing duct 252, and is fed into the main body upon rotation of sheet feed rollers 253. Also, a manual feed tray 254 which can store 100 sheets is equipped.

Furthermore, a discharge flapper 237 switches the route to the side of a transfer path 238 or to that of a discharge path 243. A down transfer path 240 reverses the sheet fed from the discharge rollers 236 via a reverse path 239, and guides the sheet to a re-feed path 241. A sheet fed from the left cassette deck 222 by the sheet feed rollers 230 is also guided to the re-feed path 241. Re-feed rollers 242 re-feed the sheet to the transfer unit having the aforementioned transfer charger 216 and the like.

Discharge rollers 244 are allocated near the discharge flapper 237, and discharge, outside the apparatus, the sheet whose path is exchanged to the side of the discharge path 243 by the discharge flapper 237.

In case of double-sided printing (double-sided copying), the discharge flapper 237 is flipped upward to guide the image-formed sheet to the re-feed path 241 via the transfer path 238, reverse path 239, and down transfer path 240. At this time, the reverse rollers 245 pull the sheet onto the reverse path 239 until the trailing end of the sheet fully leaves the transfer path 238 and the reverse rollers 245 nip the sheet. Then, by reversing the reverse rollers 245, the sheet is fed onto the down transfer path 240. When the sheet is reversed and is discharged from the main body, the discharge flapper 237 is flipped upward, and the reverse rollers 245 pull the sheet onto the reverse path 239 to a position where the trailing end of the sheet is still on the transfer path 238. After that, by reversing the reverse rollers 245, the sheet is reversed, and is fed toward the discharge rollers 244.

A discharge processing unit 290 stacks and aligns, on a processing tray 294, sheets discharged one by one from the digital MFP 1000. Upon completion of discharge of some image-formed sheets, a transferred (image-formed) sheet bundle is stapled and is discharged onto a discharge tray 292 or 293. The discharge tray 293 is controlled to move upward or downward by a motor (not shown), and moves to the position of the processing tray before the beginning of an image-forming processing operation. On a sheet tray 291, partition sheets to be inserted between discharged transferred sheets are stacked. A Z-folding device 295 Z-folds discharges transferred sheets. A bookbinding device 296 center-folds and staples some discharged transferred sheets to bind them. The bound sheet bundle is discharged onto a discharge tray 297.

Figure 3:
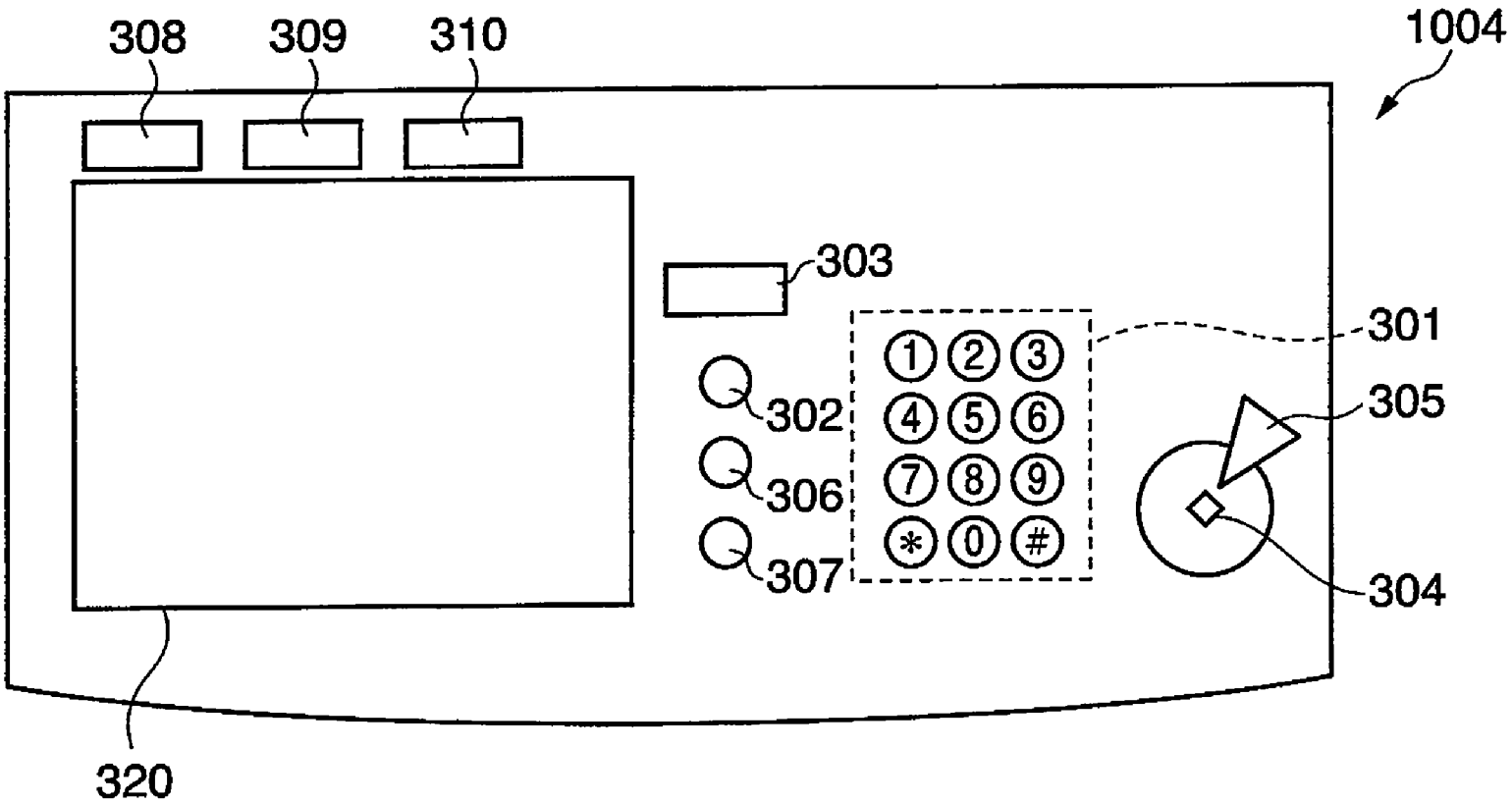
FIG. 3 depicts a perspective view showing the outer appearance of a console unit of the digital MFP according to the embodiment of the present invention.

FIG. 3 depicts a perspective view showing the outer appearance of the console unit 1004 of the digital MFP according to this embodiment.

A numeric keypad 301 is used to input a numeric value upon setting of the number of sheets which are to undergo image formation, and upon setting of a mode. On a facsimile setting window, the numeric keypad 301 is used to input, e.g., a telephone number. A clear key 302 is used to clear settings input using the numeric keypad 301. A reset key 303 is used to reset the set number of sheets which are to undergo image formation, operation mode, selection of sheet feeding units, and the like to prescribed values. A start key 304 is pressed when the user wants to start an image-forming operation. Red and green LEDs (not shown) are arranged at the center of this start key 304 so as to indicate if image formation is ready to start. If image formation is not ready to start, the red LED is turned on; if image formation is ready to start, the green LED is turned on. When the user wants to stop a copying operation, he or she uses a stop key 305. A guide key 306 is pressed when the user wants to know a given key function. Upon pressing the guide key 306, an explanation of a function of which the user wants to know is displayed on a display unit 320. An interrupt key 307 is pressed when the user wants to do another work during the image-forming operation.

The display unit 320 comprises a liquid crystal display or the like, and the display contents change according to a mode to be set so as to facilitate detailed mode settings. A touch sensor is provided to the surface of this display unit 320. When the user touches a part within the frame of a given function displayed on the display screen, that function is executed. A proof print function key as that used to execute proof printing is included in those displayed on the display screen. A copy function key 308, facsimile function key 309, and box function key 310 are respectively used to designate copy, facsimile, and box functions. Upon pressing of one of these keys, the display contents on the display unit 320 of the console unit 1004 are exchanged. Upon pressing of the copy function key 308, the user can make various settings associated with the copy function on a window (not shown). Upon pressing of the facsimile function key 309, the user can make various settings associated with the facsimile function on a window (not shown). The box function key 310 is pressed upon storing image data in the storage unit 1112 or upon printing out the stored image data.

Figure 4:
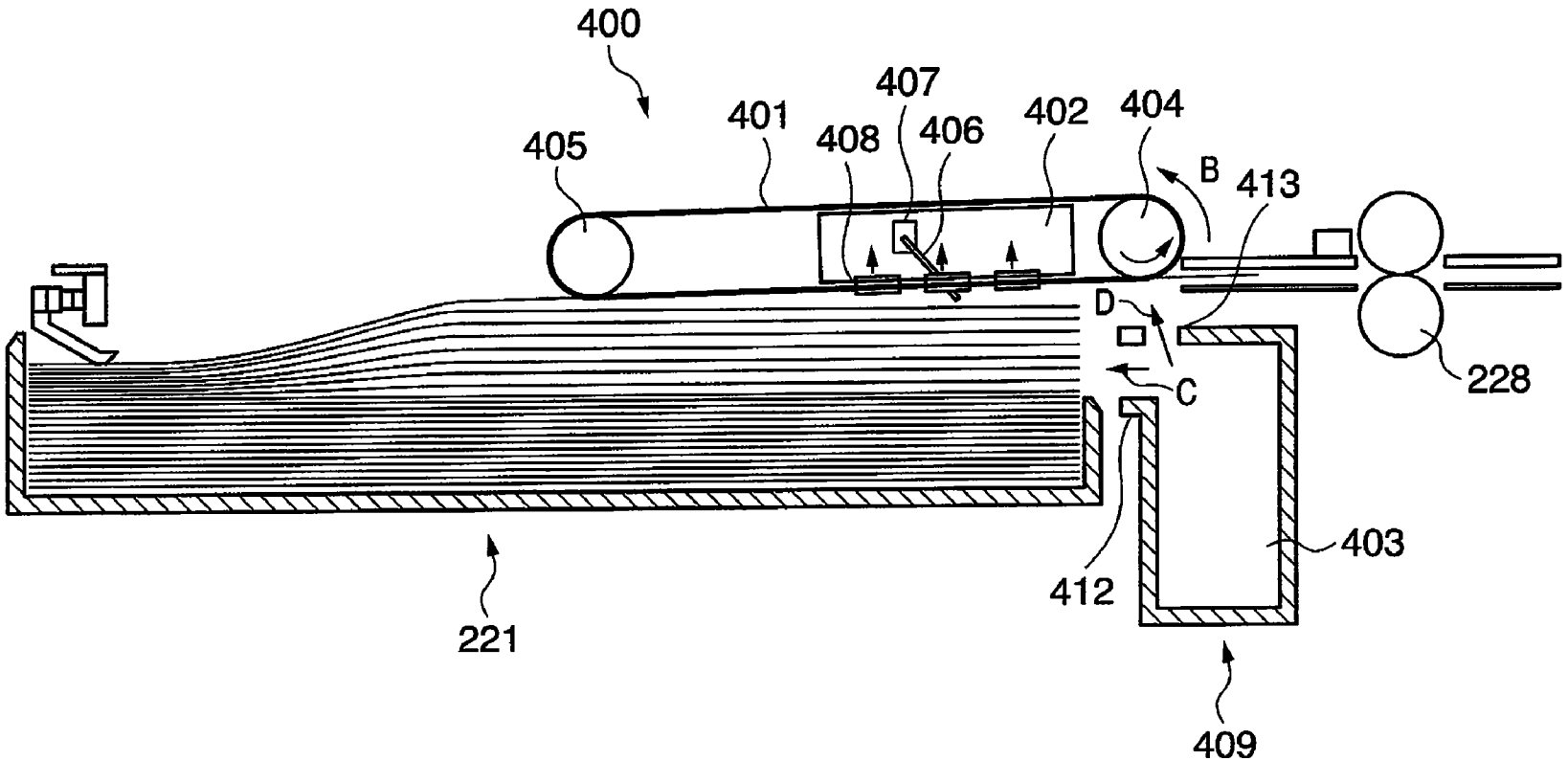
FIG. 4 depicts a sectional view explaining a sheet absorptive transfer unit provided to a right cassette deck according to the embodiment of the present invention.

FIG. 4 depicts a sectional view explaining a sheet absorptive transfer unit 400 provided to the right cassette deck 221 according to this embodiment. Note that this sheet absorptive transfer unit 400 may be provided to the left cassette deck 222, upper cassette 223, lower cassette 224, and deck 250 shown in FIG. 1. The digital MFP 1000 shown in FIG. 2 is an example in which a sheet absorptive transfer unit shown in FIG. 4 is equipped on the deck 250.

Figure 5:
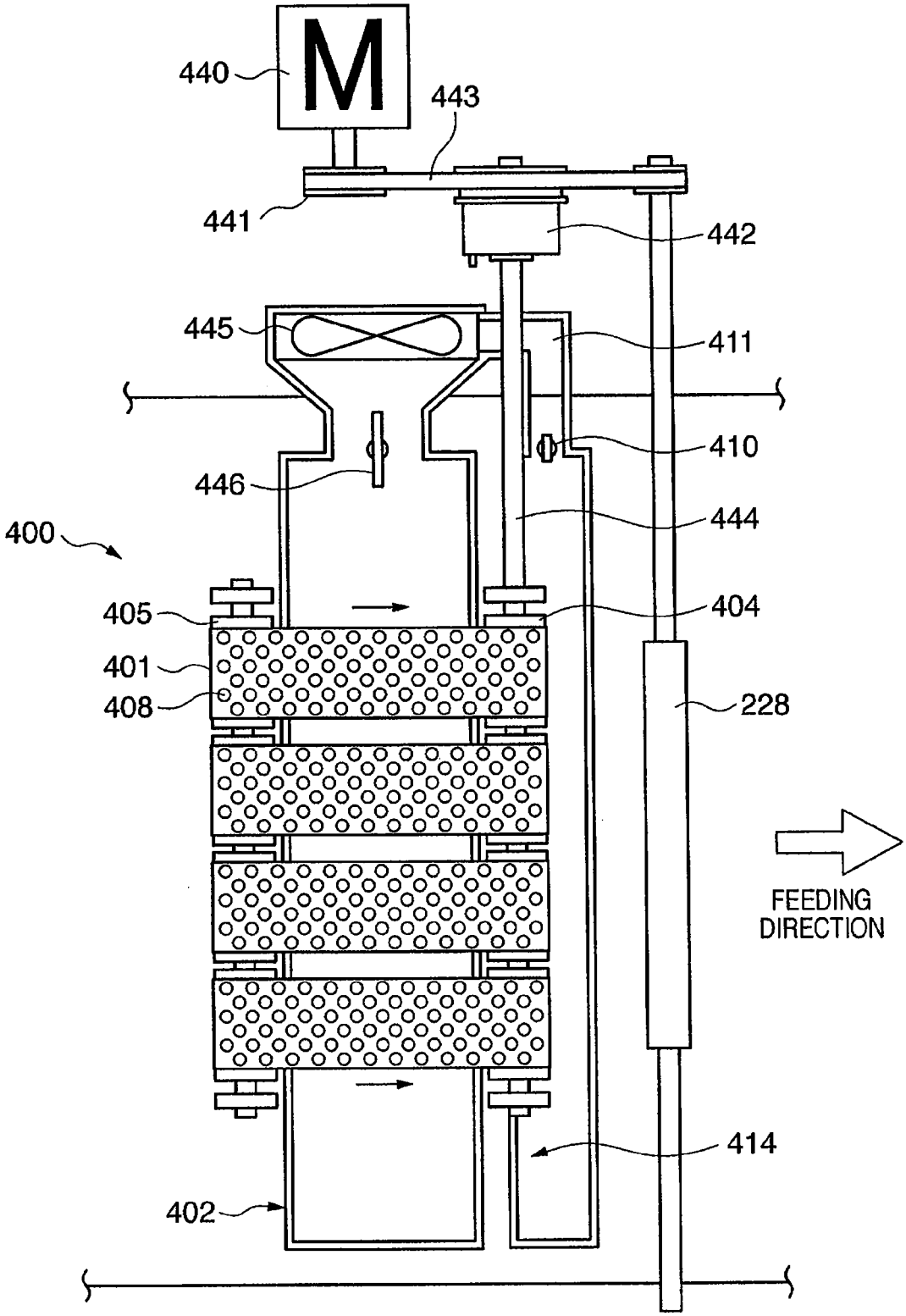
FIG. 5 depicts a bottom view explaining a driving unit of the sheet absorptive transfer unit according to the embodiment of the present invention when viewed from the sheet side.

This sheet absorptive transfer unit 400 includes a transfer belt 401, a driving unit shown in FIG. 5, absorbing duct 402, blow-out duct 403, and the like. The transfer belt 401 is allocated on the cassette deck 221 with its feeding direction side slanted slightly upward. This transfer belt 401 is wound around a driving roller 404 and a driven roller 405, and is rotated in the direction of an arrow B upon rotation of the driving roller 404. On the surface of the transfer belt 401, absorbing holes 408 used to absorb a sheet are formed. The absorbing duct 402 includes an absorptive sensor lever 406 which pivots upward when it is pressed by a sheet absorbed by the transfer belt 401. The absorbing duct 402 also includes an absorptive sensor 407 which outputs an absorption signal by detecting absorption of a sheet by the transfer belt 401 based on the upward pivotal motion of this absorptive sensor lever 406. Note that the mounting position of the sheet absorptive transfer unit 400 varies depending on the cassette deck 221 or 222, cassette 223 or 224, and deck 250. For example, the absorbing duct 252 equipped on the deck 250 shown in FIG. 2 corresponds to the absorbing duct 402 shown in FIG. 4, and the blow-out duct 255 corresponds to the blow-out duct 403 shown in FIG. 4.

FIG. 5 depicts a bottom view explaining the driving unit of the sheet absorptive transfer unit according to this embodiment when viewed from the sheet side.

This driving unit moves the transfer belt 401 in the direction of an arrow in FIG. 5 by rotating the driving roller 404. This driving unit comprises a motor 440, gear pulley 441, clutch 442, and the like, as shown in FIG. 5. The driving force of the motor 440 is transmitted to the input shaft of the clutch 442 via the gear pulley 441 and a belt 443. The clutch 442 is connected to a driving shaft 444 of the driving roller 404. Therefore, when the CPU 1113 connects the driving shaft 444 of the driving roller 404 to the clutch 442, the driving force of the motor 440 is transmitted to the driving roller 404 via the driving shaft 444, thus moving the transfer belt 401.

The absorbing duct 402 absorbs air via the absorbing holes 408 of the transfer belt 401, and is allocated within the path of the transfer belt 401. By activating a fan 445 (FIG. 5) and absorbing air via the absorbing duct 402, a negative pressure is produced near the absorbing holes 408. Inside the absorbing duct 402, an absorbing valve 446 used to adjust the absorbing amount of air is arranged (FIG. 5). Note that the air absorbed upon operation of the fan 445 is supplied to a separation unit 409 (FIG. 4), and is blown out.

The separation unit 409 helps absorptive transfer of a sheet by blowing air to the end portion of sheets to float and separate a sheet. This separation unit 409 comprises the blow-out duct 403, a valve 410, a junction duct 411, the fan 445, and the like.

The blow-out duct 403 is allocated downstream in the feeding direction of the cassette deck 221 and below the driving roller 404, as shown in FIG. 4. The blow-out duct 403 is formed with a handling nozzle 412 that blows out air in the direction of an arrow C (horizontal direction) in FIG. 4, and a separation nozzle 413 that blows out air in the direction of an arrow D. The air to be blown out from these handling nozzle 412 and separation nozzle 413 is supplied from the fan 445 via the junction duct 411. At the connecting portion between a blow-out duct 414 and the junction duct 411, a valve 410 used to adjust the air blow-out amount is allocated (FIG. 5). The degree of opening of the valve 410 is adjustable according to an instruction from the CPU 1113.

Figure 6:
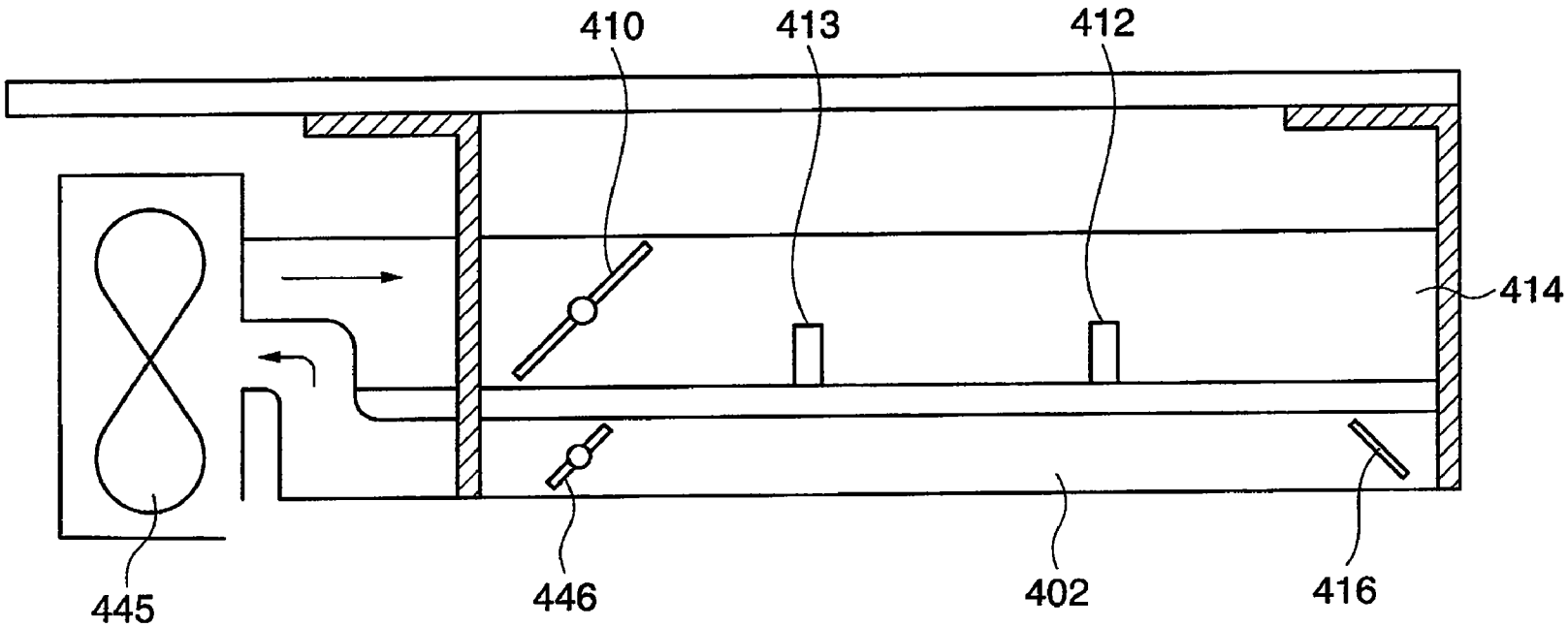
FIG. 6 depicts a side view of the sheet absorptive transfer unit according to the embodiment of the present invention when viewed from the left side of FIG. 5.

FIG. 6 depicts a side view of the sheet absorptive transfer unit according to this embodiment when viewed from the left side of FIG. 5.

The fan 445 is driven by a motor (not shown) which rotates according to an instruction from the CPU 1113. The fan 445 is also used to absorb air from the aforementioned absorbing duct 402, as shown in FIG. 5. That is, the fan 445 serves for both absorption in the sheet absorptive transfer unit 400 and air blasting in the separation unit 409. FIG. 6 shows the flows of air between the absorbing duct 402 and blow-out duct 414.

When such arrangement is adopted, the amount of air to be blown out from the blow-out duct 414 may become short by only performing absorption suited to absorb a sheet in some cases. Also, air may be blown out to the blow-out duct 414 without any absorption in the absorbing duct 402 in some cases. For these purposes, a portion of the absorbing duct 402 on the upstream side of an opening is open to the air. A relief valve 416 is arranged on the downstream side from this opening. This relief valve 416 closes the opening of the absorbing duct 402 by its self weight. However, when the negative pressure in the absorbing duct 402 becomes equal to or higher than a predetermined value, the relief valve 416 opens since it is pressed by the atmosphere pressure, so as to introduce air into the absorbing duct 402. That is, the relief valve 416 serves as a constant pressure valve. The sheet feed rollers 229 transfer a sheet transferred by this sheet absorptive transfer unit 400 to the transfer unit, and are arranged downstream in the feeding direction of the sheet absorptive transfer unit 400.

The air feeding operation by the deck 250 which comprises the sheet absorptive transfer unit 400 shown in FIGS. 4, 5, and 6 will be described below.

The fan 445 and motor 440 are enabled to open the valve 410 and to supply air to the blow-out duct 403. As a result, the handling nozzle 412 and separation nozzle 413 blow out air in predetermined directions, thus starting handling processing. At this time, the air blown out from the handling nozzle 412 enters between sheets, thus making several upper sheets of the sheet bundle float while being handled. Note that this handling processing is executed for a predetermined period of time within which the floating several upper sheets of the sheet bundle would become stable.

After executing the aforementioned handling processing for the predetermined period of time, the absorbing valve 446 is opened. Then a negative pressure is produced inside the absorbing duct 402, and an uppermost sheet S of those which float by the air from the handling nozzle 412 is absorbed on the surface of the transfer belt 401. At this time, the air blown out from the separation nozzle 413 separates the uppermost sheet from other sheets. In this manner, a sheet other than the uppermost sheet is never absorbed together.

When the absorptive sensor 407 provided in side the absorbing duct 402 detects absorption of a sheet on the surface of the transfer belt 401, the clutch 442 is connected to rotate the transfer belt 401. As a result, the sheet absorbed by the transfer belt 401 is transferred in the feeding direction. In this way, sheets loaded in the deck 250 are fed one by one.

The aforementioned handling processing is one of preparation processes required to attain air feeding from the cassette or deck (they will be generally referred to as an air-feeding unit hereinafter) which make air feeding. Upon completion of such preparation processes, the air-feeding unit can transit to a ready-to-feed state, thus starting feeding from the air-feeding unit.

[First Embodiment]

The exchange control processing between roll feeding and air feeding of the digital MFP according to the first embodiment of the present invention will be described below.

Figure 7:
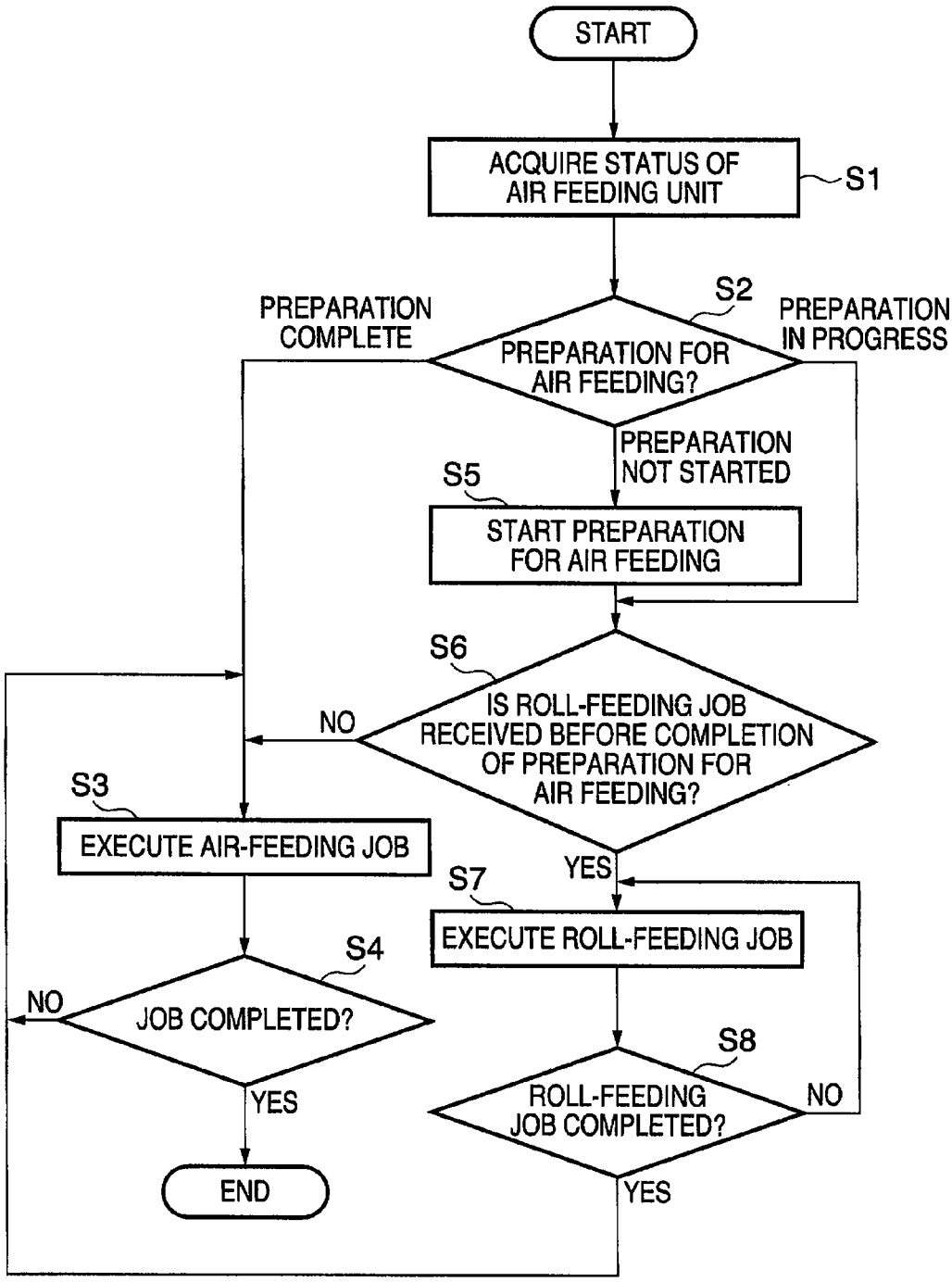
FIG. 7 is a flowchart explaining the processing for exchanging between roll feeding and air feeding of the digital MFP according to the first embodiment.

FIG. 7 is a flowchart explaining the processing for exchanging between roll feeding and air feeding of the digital MFP according to the first embodiment. Note that a program that implements this processing is stored in the ROM 115, and is executed under the control of the CPU 1113.

This processing starts when this digital MFP 1000 receives a print job to be executed by air feeding (to be referred to as an air-feeding print job hereinafter). After reception of this print job, in step S1 the CPU 1113 acquires the status of the air-feeding unit to discriminate the state of the air-feeding unit. The CPU 1113 determines in step S2 whether or not a preparation to sheets from the air-feeding unit is complete. In this embodiment, it is determined whether or not the preparation to sheets from the air-feeding unit is complete by seeing if the aforementioned handling processing is complete. More specifically, if a predetermined period of time has elapsed after the beginning of blowing out of air from the handling nozzle 412 and separation nozzle 413, the CPU 1113 determines that the handling processing is complete. Note that the process in step S2 may be implemented by other determination methods as long as the CPU 1113 determines whether or not the preparation to sheets from the air-feeding unit is complete. If the CPU 1113 determines that the preparation to sheets from the air-feeding unit is complete, the process advances to step S3 to execute the received print job by feeding sheets from the deck or cassette that stores corresponding sheets by air feeding. Then, the process advances to step S4. The CPU 1113 determines in step S4 whether or not this air-feeding job is complete. If it is determined that the job is not complete yet, the CPU 1113 continues to execute step S3; otherwise, this processing ends.

On the other hand, if the CPU 1113 determines in step S2 that the preparation for the air-feeding unit is not complete because, e.g., the handling processing is underway but it is not complete yet (preparation for air feeding underway), the process advances to step S6.

If it is determined in step S2 that the handling processing is not started (preparation for air feeding is not started), the process advances to step S5 to start the handling processing, i.e., the preparation for air feeding. The process then advances to step S6. Note that the air-feeding print job waits without starting execution.

The CPU 1113 determines in step S6 whether or not a print job that designates printing by roll feeding (to be referred to as a roll-feeding print job hereinafter) is input before the preparation for air feeding is completed and the air-feeding print job is ready to be executed (air feeding is ready) (during waiting of the air-feeding print job). If it is determined in step S6 that no roll-feeding print job is input before the preparation for air feeding is completed, the process advances to step S3 to execute the received print job by feeding sheets from the deck or cassette, which store corresponding sheets, by air feeding after completion of the preparation for air feeding.

On the other hand, if it is determined in step S6 that a roll-feeding print job is input before completion of the preparation for air feeding, the process advances to step S7 to execute the received print job by feeding sheets from the deck or cassette, which store corresponding sheets, by roll feeding. Upon completion of the roll-feeding print job in step S8, the process advances to step S3 to execute the received print job by feeding sheets from the deck or cassette, which store corresponding sheets, by air feeding after completion of the preparation for air feeding. The CPU 1113 determines in step S4 whether or not this air-feeding print job is complete. Upon completion of the print job, this processing ends. If it is determined in step S8 that the roll-feeding print job is complete, the process may return to step S1 to execute the aforementioned processing.

As described above, according to the first embodiment, upon reception of a roll-feeding print job during the preparation for air feeding after an air-feeding print job is received, the roll-feeding print job is executed before the air-feeding print job. In this way, a total print waiting time upon execution of print jobs can be shortened.

[Second Embodiment]

In the first embodiment, upon reception of a roll-feeding print job during the preparation for air feeding, the roll-feeding print job is unconditionally executed. By contrast, in the second embodiment, in a case that the number of pages to be printed of a print job using the roll feeding is equal to or smaller than a prescribed value, the roll-feeding print job is executed, thus preventing the start of air feeding from delaying more than necessary.

Figure 8:
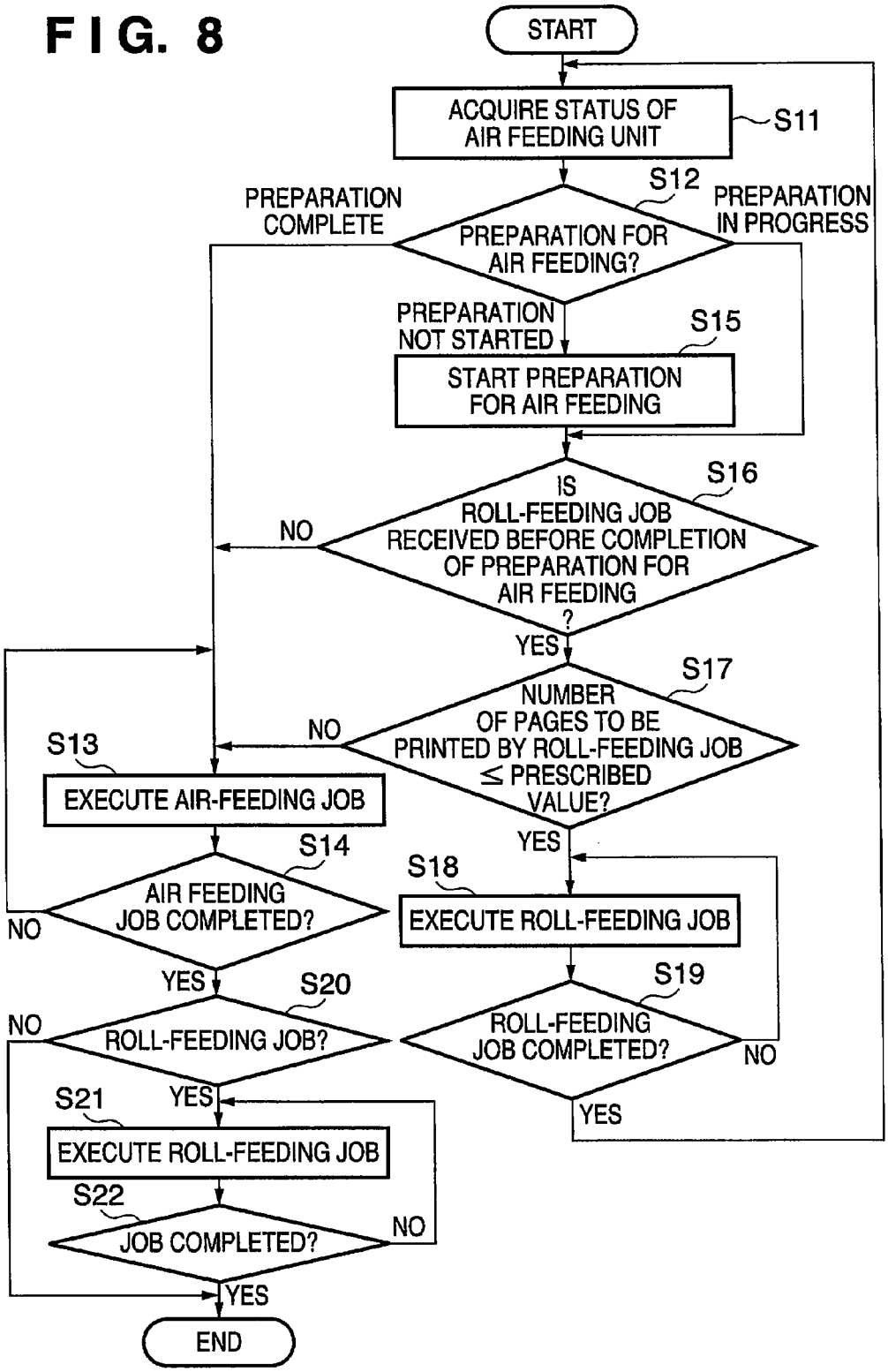
FIG. 8 is a flowchart explaining the processing for exchanging between roll feeding and air feeding of the digital MFP according to the second embodiment.

FIG. 8 is a flowchart explaining the processing for exchanging between roll feeding and air feeding in the digital MFP according to the second embodiment. Note that a program that implements this processing is stored in the ROM 115, and is executed under the control of the CPU 1113. Since the hardware arrangement of the digital MFP according to the second embodiment is the same as that in the first embodiment described above, a repetitive description thereof will be avoided. Since the processes in steps S11 to S16 in FIG. 8 are basically the same as those in steps S1 to S6 in FIG. 7 described above, a description of the common processes will not be given.

The CPU 1113 determines in step S16 whether or not a print job that designates printing by roll feeding is input before the preparation for air feeding is completed and the air-feeding print job is ready to be executed. If it is determined in step S16 that the roll-feeding print job is input, the process advances to step S17 to determine whether or not the number of pages to be printed by the roll-feeding print job is equal to or smaller than a prescribed value. If the CPU 1113 determines that the number of pages is larger than the prescribed value, the process advances to step S13 to execute the air-feeding print job, which is received first, after completion of the preparation for air feeding.

On the other hand, if it is determined in step S17 that the number of pages to be printed by the roll-feeding print job is equal to or smaller than the prescribed value, the process advances to step S18 to execute the received print job by feeding sheets from the deck or cassette, which store corresponding sheets, by roll feeding. The CPU 1113 waits for completion of the roll-feeding print job in step S19. Upon completion of the job, the process returns to step S11 to execute the aforementioned processing. Note that upon completion of the roll-feeding print job in step S19, the process may advance to step S13 to execute the air-feeding print job like in FIG. 7.

Upon completion of the air-feeding print job in step S14, the process advances to step S20 to determine whether or not a roll-feeding print job was received before or during execution of the air-feeding print job. If it is determined in step S20 that no roll-feeding print job was received, the processing ends; otherwise, the process advances to step S21 to execute the received print job by feeding sheets from the deck or cassette, which store corresponding sheets, by roll feeding. Upon completion of that print job in step S22, this processing ends.

Note that "the number of pages of the print job" may be replaced by the number of pages of a document to be printed. Alternatively, the total number of sheets to be fed by roll feeding for the print job, which is determined by the number of pages of a document to be printed and the print settings for that print job, may be used. The print settings for the print job include the number of copies to be printed, double/single-sided settings, imposition settings (N-up or the like), and so forth.

As described above, according to the second embodiment, upon reception of a roll-feeding print job during the preparation for air feeding after an air-feeding print job is received, in a case that the number of pages of that print job is equal to or smaller than the prescribed value, the roll-feeding print job is executed. On the other hand, in a case that the number of pages is larger than the prescribed value, not the roll-feeding print job but the first air-feeding print job is executed, thus preventing any delay of the air-feeding print job.

If the number of pages to be printed by a print job is appropriately set, an air-feeding or roll-feeding print job can be preferentially executed. As a result, a total print waiting time can be shortened.

[Third Embodiment]

The third embodiment is characterized in that in a case that a succeeding roll-feeding print job is executed before a preceding air-feeding print job, the issuer of the preceding print job, e.g., the user of a client PC which issued the print job first, is notified of that information.

Figure 9:
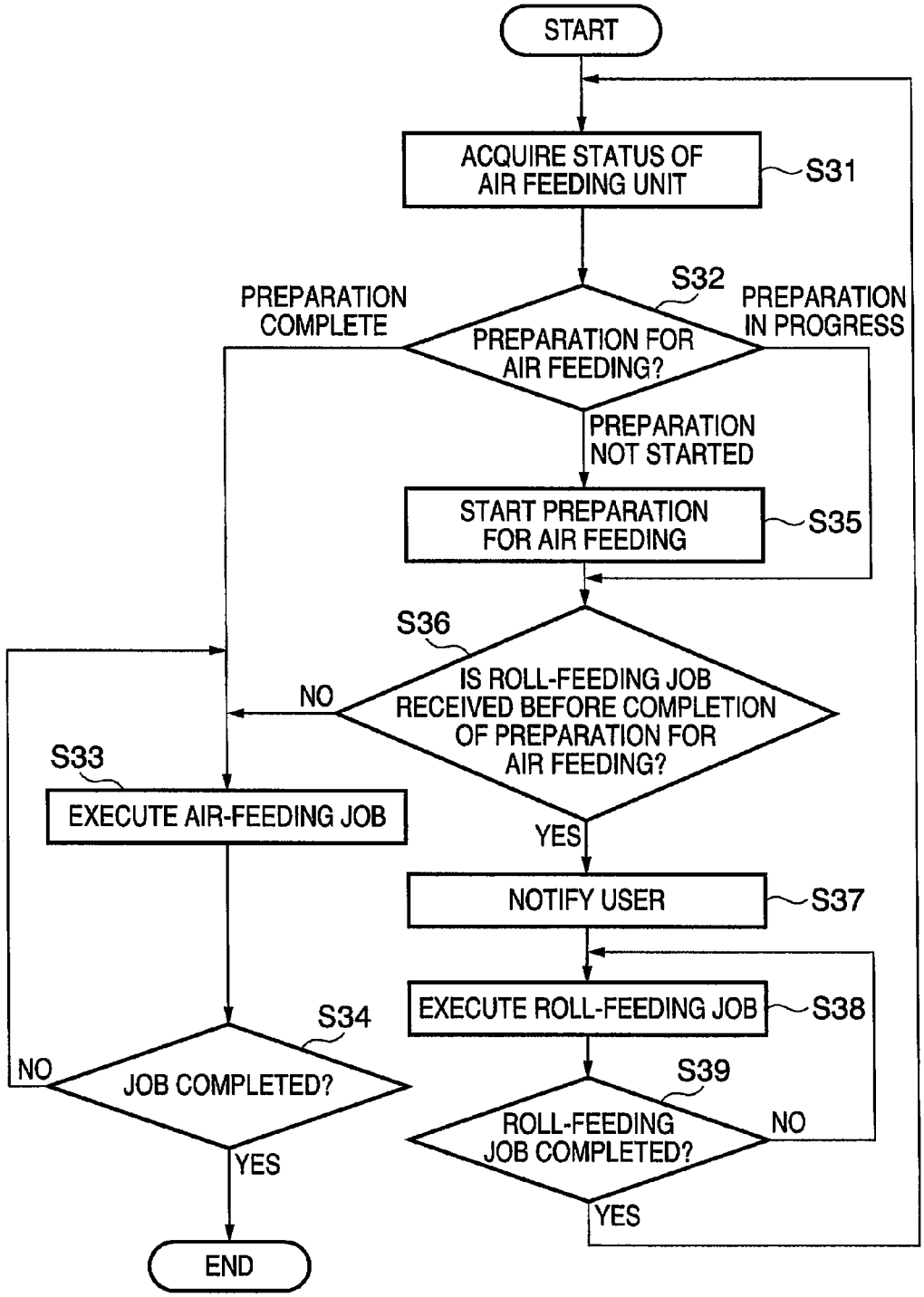
FIG. 9 is a flowchart explaining the processing for exchanging between roll feeding and air feeding of the digital MFP according to the third embodiment.

FIG. 9 is a flowchart explaining the processing for exchanging between roll feeding and air feeding in the digital MFP according to the third embodiment. Note that a program that implements this processing is stored in the ROM 115, and is executed under the control of the CPU 1113. Since the hardware arrangement of the digital MFP according to the third embodiment is the same as that in the first embodiment described above, a repetitive description thereof will be avoided. Since the processes in steps S31 to S36 and steps S38 and S39 in FIG. 9 are the same as those in steps S1 to S6 and steps S7 and S8 in FIG. 7, a repetitive description thereof will be avoided.

The CPU 1113 determines in step S36 whether or not a print job that designates printing by roll feeding is input before the preparation for air feeding is completed and the air-feeding print job is ready to be executed. If it is determined in step S36 that the roll-feeding print job is input, the process advances to step S37 to notify a computer as a transmission source of the previously received air-feeding print job that the processing order of that print job is changed. The process then advances to step S38 to execute the roll-feeding print job. Note that the process in step S38 is the same as that in step S7 in FIG. 7 described above. In this case as well, upon completion of the roll-feeding print job in step S39, if it can be determined that the preparation for air feeding is complete, the process may advance to step S33 to immediately execute the air-feeding print job.

As described above, according to the third embodiment, in a case that a roll-feeding print job is received during the preparation for air feeding after an air-feeding print job is received, and the print processing order of the previously received print job is changed, the transmission source of the air-feeding print job which has received first is notified of that information.

[Fourth Embodiment]

The fourth embodiment has the following characteristic feature. That is, if a roll-feeding print job is received before completion of the preparation for an air-feeding print job, then the roll-feeding print job is executed. Upon completion of the preparation for air feeding during execution of the roll-feeding print job, the job is switched to the air-feeding print job without waiting for completion of the roll-feeding print job.

Figure 10:
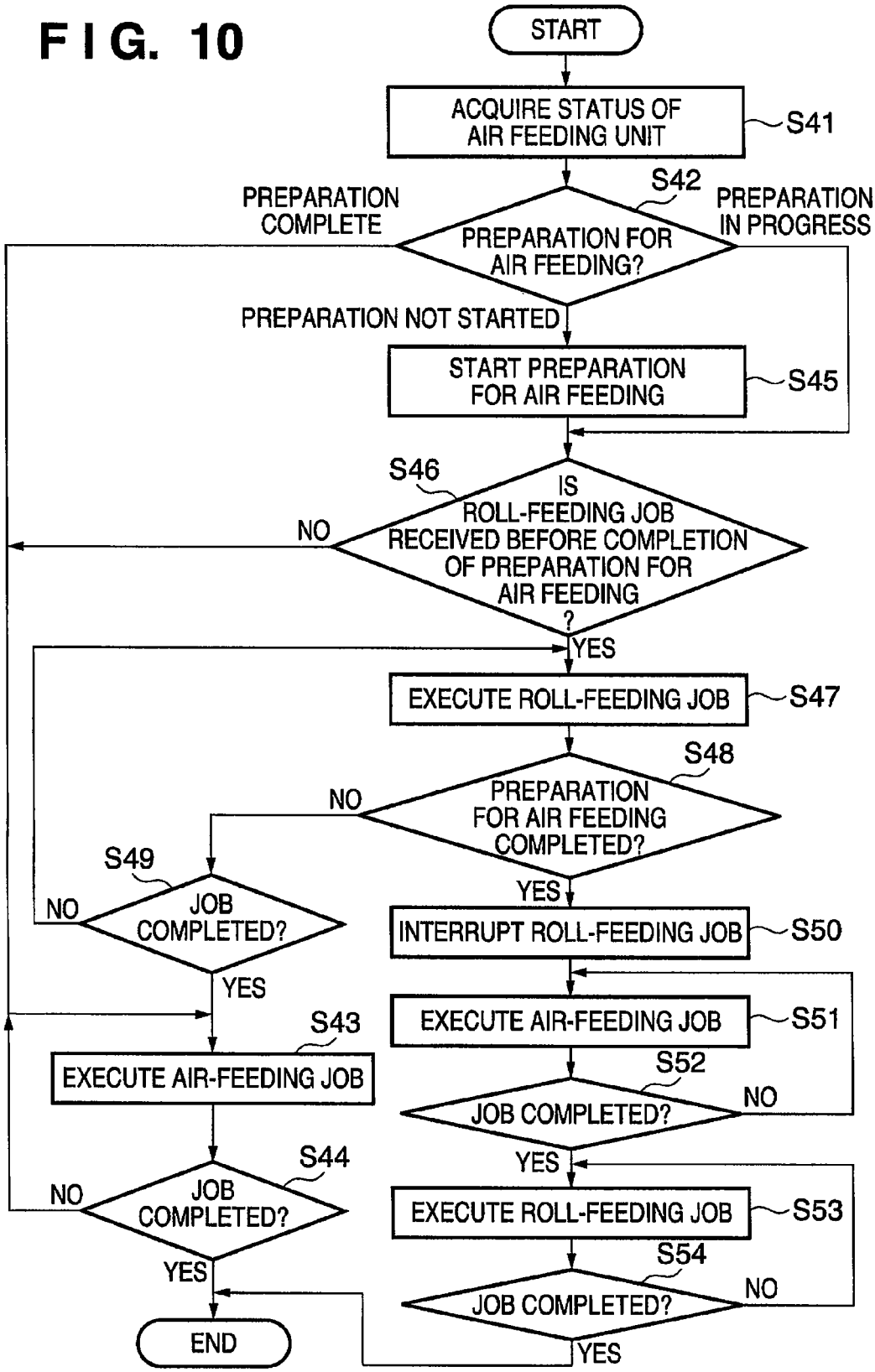
FIG. 10 is a flowchart explaining the processing for exchanging between roll feeding and air feeding of the digital MFP according to the fourth embodiment.

FIG. 10 is a flowchart explaining the processing for exchanging between roll feeding and air feeding in the digital MFP according to the fourth embodiment. Note that a program that implements this processing is stored in the ROM 115, and is executed under the control of the CPU 1113. Since the hardware arrangement of the digital MFP according to the fourth embodiment is the same as that in the first embodiment described above, a repetitive description thereof will be avoided. Since the processes in steps S41 to S46 in FIG. 10 are basically the same as those in steps S1 to S6 in FIG. 7 described above, a description of the common processes will not be given.

The CPU 1113 determines in step S46 whether or not a print job that designates printing by roll feeding is input before the preparation for air feeding is completed and the air-feeding print job is ready to be executed. If it is determined in step S46 that the roll-feeding print job is input, the process advances to step S47 to execute the roll-feeding print job in the same manner as in the process in step S7 (FIG. 7). The CPU 1113 determines in step S48 whether or not the preparation for air feeding is complete before completion of the roll-feeding print job. If it is determined in step S48 that the preparation for air feeding is not complete yet, the process advances to step S49 to determine whether or not the roll-feeding print job is complete. If this print job is not complete yet, the process advances to step S47 to continue execution of the roll-feeding print job. On the other hand, if the roll-feeding print job is complete in step S49, the process advances to step S43 to execute the air-feeding print job after completion of the preparation for air feeding.

If the CPU 1113 determines in step S48 that the preparation for air feeding is complete before completion of the roll-feeding print job, the process advances to step S50 to interrupt the roll-feeding print job, which is being currently executed. The process advances to step S51 to execute the air-feeding print job which was received first in the same manner as in step S43. The CPU 1113 executes steps S51 and S52 until it determines in step S52 that the air-feeding print job is complete. Upon completion of the air-feeding print job, the process advances from step S52 to step S53 to restart the interrupted roll-feeding print job. If the roll-feeding print job is complete in step S54, this processing ends.

As described above, according to the fourth embodiment, if a roll-feeding print job is received during the preparation for air feeding after reception of an air-feeding print job, then the roll-feeding print job is executed. If the preparation for air feeding is complete during execution of this job, the air-feeding print job is preferentially executed. As a result, the print jobs can be executed without changing the final print order, and a time required until the first print job is completed can be prevented from being prolonged.

[Fifth Embodiment]

In the fifth embodiment, upon reception of a roll-feeding print job before completion of the preparation for air feeding in the fourth embodiment, if that print job designates neither a staple nor bookbinding process, the roll-feeding print job is executed. On the other hand, if the roll-feeding print job designates a staple or bookbinding process, the air-feeding print job is executed. In this way, completion of the air-feeding print job can be prevented from being delayed.

Figure 11:
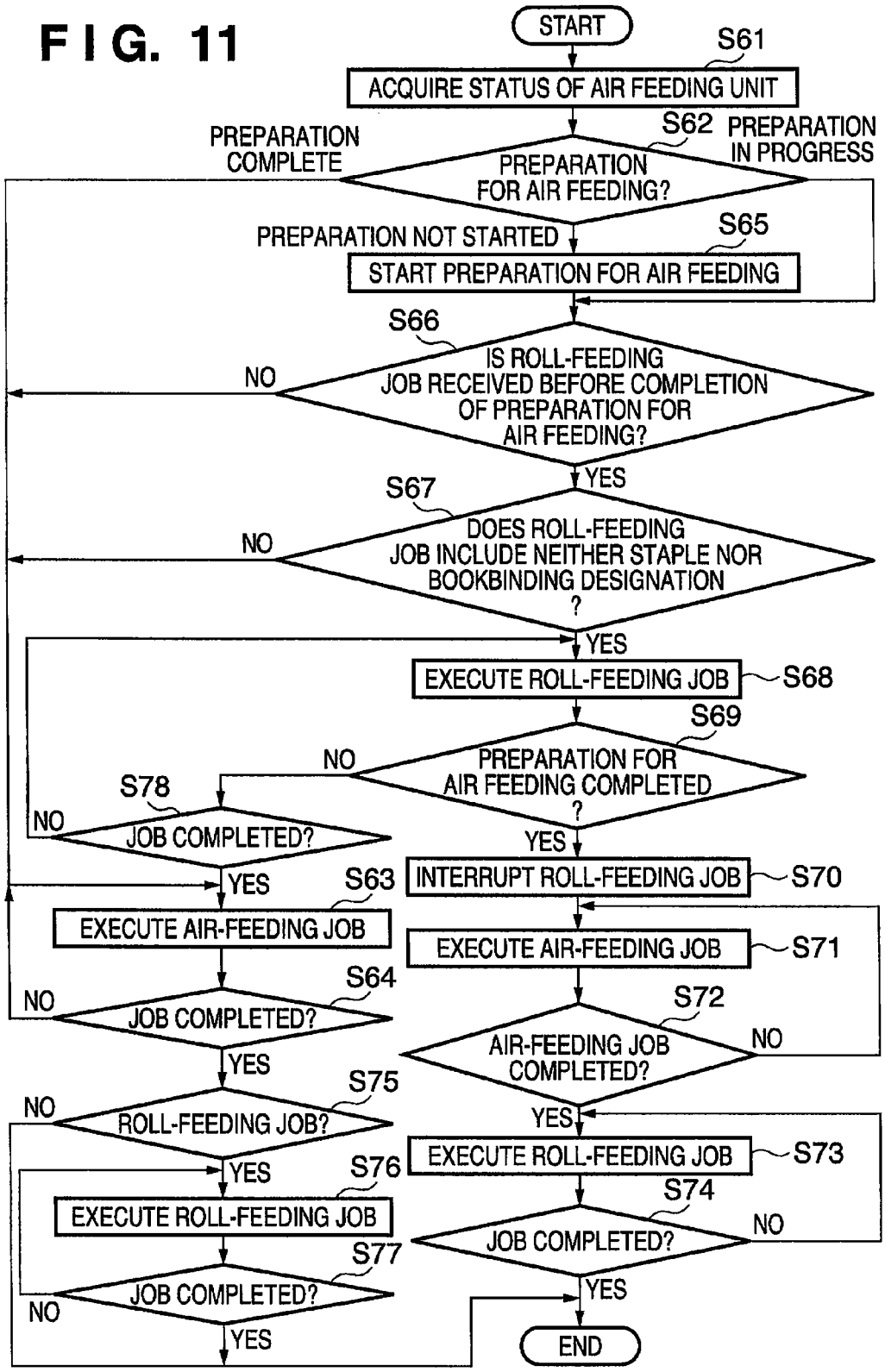
FIG. 11 is a flowchart explaining the processing for exchanging between roll feeding and air feeding of the digital MFP according to the fifth embodiment.

FIG. 11 is a flowchart explaining the processing for exchanging between roll feeding and air feeding in the digital MFP according to the fifth embodiment. Note that a program that implements this processing is stored in the ROM 115, and is executed under the control of the CPU 1113. Since the hardware arrangement of the digital MFP according to the fifth embodiment is the same as that in the first embodiment described above, a repetitive description thereof will be avoided. Since the processes in steps S61 to S66 in FIG. 11 are basically the same as those in steps S1 to S6 in FIG. 7 described above, a description of the common processes will not be given.

The CPU 1113 determines in step S66 whether or not a print job that designates printing by roll feeding is input before the preparation for air feeding is completed and the air-feeding print job is ready to be executed. If it is determined that the roll-feeding print job is input, the process advances to step S67 to determine whether or not that print job includes either a staple or bookbinding designation. If the print job includes either a staple or bookbinding designation, the process advances to step S63 to execute the previously received air-feeding print job after completion of the preparation for air feeding. In this way, sheets printed by the roll-feeding print job and those printed by the air-feeding print job can be prevented from undergoing the staple or bookbinding process together.

On the other hand, if it is determined in step S67 that the print job includes neither a staple nor bookbinding designation, the process advances to step S68 to execute the roll-feeding print job. The CPU 1113 then determines in step S69 whether or not the preparation for air feeding is complete before completion of the roll-feeding print job. If it is determined in step S69 that the preparation for air feeding is not complete yet, the process advances to step S78 to determine whether or not the roll-feeding print job is complete. If this print job is not complete yet, the process returns to step S68 to continue execution of the roll-feeding print job. On the other hand, if the roll-feeding print job is complete in step S78, the process advances to step S63 to execute the air-feeding print job after completion of the preparation for air feeding.

If the CPU 1113 determines in step S69 that the preparation for air feeding is complete before completion of the roll-feeding print job, the process advances to step S70 to interrupt the roll-feeding print job, which is currently being executed. The process then advances to step S71 to execute the air-feeding print job, which was received first. The CPU 1113 executes steps S71 and S72 until the air-feeding print job is completed in step S72. If the air-feeding print job is complete, the process advances from step S72 to S73 to restart the interrupted roll-feeding print job. Upon completion of the roll-feeding print job in step S74, this processing ends. These processes in steps S70 to S74 are the same as those in steps S50 to S54 in FIG. 10.

If it is determined in step S64 that the air-feeding print job is complete, the process advances to step S75 to determine whether or not a roll-feeding print job still remains. If it is determined in step S75 that no roll-feeding print job remains, this processing ends; otherwise, the process advances to step S76 to execute the roll-feeding print job. If this print job designates the staple process, bookbinding process, and the like, these processes are also executed in step S76. After completion of this roll-feeding print job in step S77, this processing ends.

As described above, according to the fifth embodiment, since the order of a print job which has a specific meaning in relation to the order of print processes such as the staple process, bookbinding process, and the like is left unchanged, the print processes can be executed without changing the final print order.

A time required until completion of the latest air-feeding print job can be prevented from being prolonged due to the staple or bookbinding process.

[Sixth Embodiment]

The sixth embodiment is characterized in that printed sheets are discharged to different destinations upon execution of a roll-feeding print job and that of an air-feeding print job.

Figure 12:
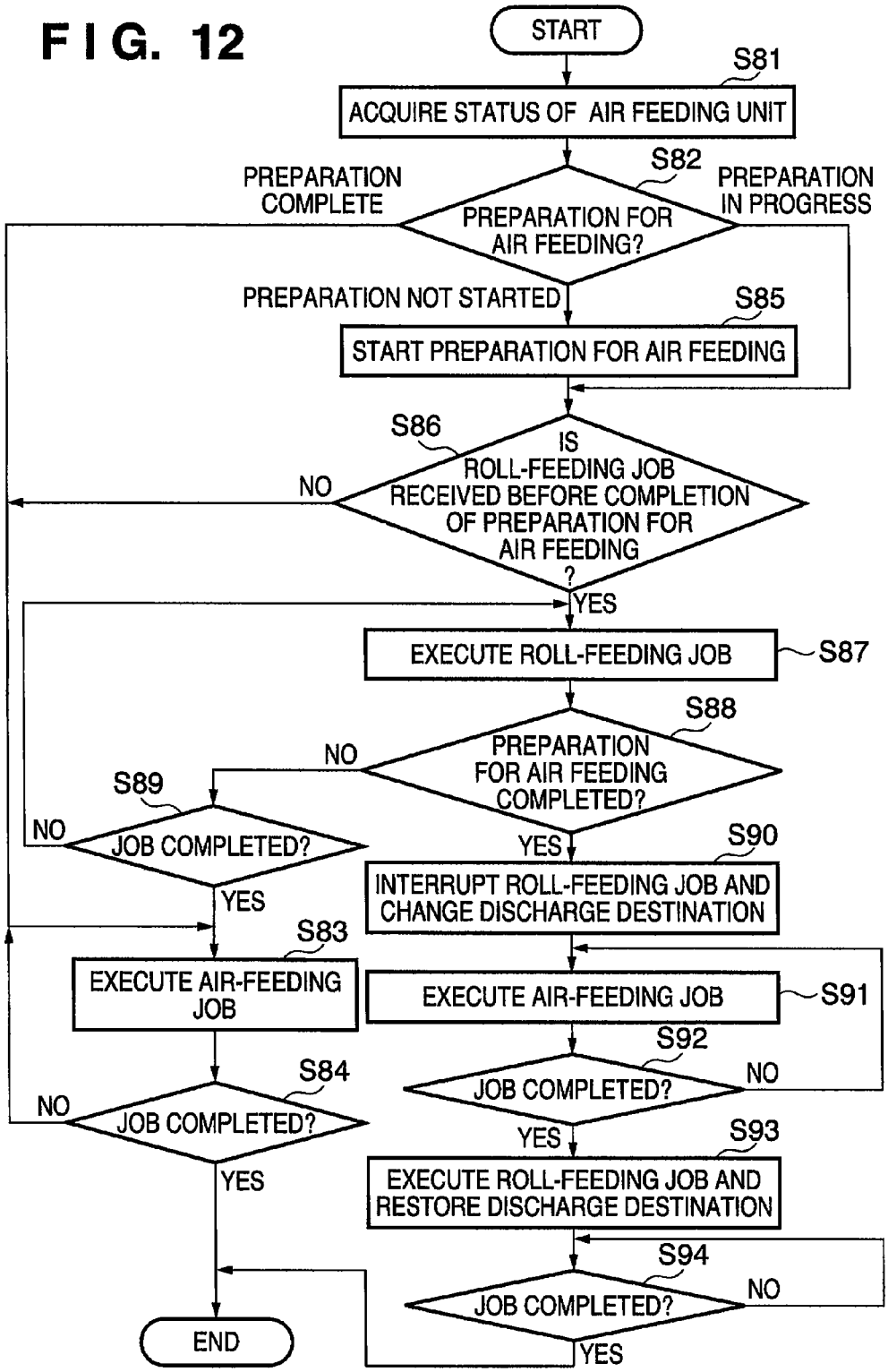
FIG. 12 is a flowchart explaining the processing for exchanging between roll feeding and air feeding of the digital MFP according to the sixth embodiment.

FIG. 12 is a flowchart explaining the processing for exchanging between roll feeding and air feeding in the digital MFP according to the sixth embodiment. Note that a program that implements this processing is stored in the ROM 115, and is executed under the control of the CPU 1113. Since the hardware arrangement of the digital MFP according to the sixth embodiment is the same as that in the first embodiment described above, a repetitive description thereof will be avoided. Since the processes in steps S81 to S86 in FIG. 12 are basically the same as those in steps S1 to S6 in FIG. 7 described above, a description of the common processes will not be given.

The CPU 1113 determines in step S86 whether or not a print job that designates printing by roll feeding is input before the preparation for air feeding is completed and the air-feeding print job is ready to be executed. If it is determined in step S86 that the roll-feeding print job is input, the process advances to step S87 to execute the roll-feeding print job. The CPU 1113 determines in step S88 whether or not the preparation for air feeding is complete before completion of the roll-feeding print job. If it is determined in step S88 that the preparation for air feeding is not complete yet, the process advances to step S89 to determine whether or not the roll-feeding print job is complete. If this print job is not complete yet in step S89, the process returns to step S87 to continue execution of the roll-feeding print job. On the other hand, if the roll-feeding print job is complete in step S89, the process advances to step S83 to execute the air-feeding print job after completion of the preparation for air feeding.

If the CPU 1113 determines in step S88 that the preparation for air feeding is complete before completion of the roll-feeding print job, the process advances to step S90 to interrupt the roll-feeding print job, which is currently being executed. The CPU 1113 then designates a discharge destination (one of the discharge trays 292, 293, and 297) of printed sheets to that different from the roll-feeding print job. The process advances to step S91 to execute the air-feeding print job which was received first. The CPU 1113 executes steps S91 and S92 until the air-feeding print job is completed in step S92. Upon completion of this air-feeding print job, the process advances from step S92 to step S93 to restore the discharge destination of the roll-feeding print job in step S87 so as to restart the interrupted roll-feeding print job. After completion of this roll-feeding print job in step S94, this processing ends.

As described above, the print results of different print jobs can be prevented from being discharged onto an identical discharge tray together.

Note that the above described embodiments can be applied not only to execution of a print job transmitted from a host computer or the like but also to a print job of the copy processing designated from the console unit 1004 of the main body or a print job received by the facsimile unit.

The third embodiment notifies a computer as the transmission source of the print job that the print job processing order has changed. The notification destination may be changed depending on print jobs designated to be executed. For example, if a print job is that of the copy processing, such message may be displayed on the console unit 1004 of the digital MFP. If a print job is transmitted from a printer driver of a user PC, that message may be displayed on the display of that PC. Furthermore, if the print job is a facsimile reception job, notification may be skipped.

The first to sixth embodiments have been independently explained, but may be combined as needed. For example, the condition indicating that the number of pages is equal to or smaller than the prescribed value in the second embodiment or the condition indicating that the print job does not include any staple or bookbinding designation in the fifth embodiment may be included in the determination conditions as to whether or not to execute the roll-feeding print job in other embodiment.

Notification to the user in the third embodiment may also be done in the other, first, second, and fourth to sixth embodiments.

Furthermore, changing of the discharge destinations for air feeding and roll feeding may be done in the other, first to fifth embodiments.

[Other Embodiments]

The embodiments of the present invention have been described in detail. The present invention can be applied to either a system constituted by a plurality of devices, or an apparatus consisting of a single device.

Note that the present invention can also be achieved by directly or remotely supplying a program of software that implements the functions of the aforementioned embodiments to a system or apparatus, and reading out and executing the supplied program code by a computer of that system or apparatus. In this case, the form of program is not particularly limited as long as it has the program function.

Therefore, the program code itself installed in a computer to implement the functional processing of the present invention using the computer implements the present invention. That is, the claims of the present invention include the computer program itself for implementing the functional processing of the present invention. In this case, the form of program is not particularly limited, and an object code, a program to be executed by an interpreter, script data to be supplied to an OS, and the like may be used as long as they have the program function.

As a recording medium for supplying the program, various media can be used: for example, a Floppy® disk, hard disk, optical disk, magneto-optical disk, MO, CD-ROM, CD-R, CD-RW, magnetic tape, nonvolatile memory card, ROM, DVD (DVD-ROM, DVD-R), and the like.

As another program supply method, a program can be supplied by establishing a connection to a home page on the Internet using a browser on a client computer, and downloading the program from the home page to a recording medium such as a hard disk or the like. In this case, the program to be downloaded may be either the computer program itself of the present invention or a compressed file including an automatic installation function. Furthermore, the program code that configures the program of the present invention may be segmented into a plurality of files, which may be downloaded from different home pages. That is, the claims of the present invention include a WWW server which makes a plurality of users download a program file required to implement the functional processing of the present invention by a computer.

Also, a storage medium such as a CD-ROM or the like, which stores the encrypted program of the present invention, may be delivered to the user. In this case, the user who has cleared a predetermined condition may be allowed to download key information that decrypts the encrypted program from a home page via the Internet, so as to install the encrypted program in a computer in an executable form using that key information.

The functions of the aforementioned embodiments may be implemented by a mode other than that by executing the readout program code by the computer. For example, an OS or the like running on the computer may execute some or all of actual processes on the basis of an instruction of that program, thereby implementing the functions of the aforementioned embodiments.

Furthermore, the program read out from the recording medium may be written in a memory equipped on a function expansion board or a function expansion unit, which is inserted in or connected to the computer. In this case, after the program is written in the memory, a CPU or the like equipped on the function expansion board or unit executes some or all of actual processes based on the instruction of that program, thereby implementing the functions of the aforementioned embodiments.

As described above, according to the first embodiment, upon reception of a roll-feeding print job during the preparation for air feeding after reception of an air-feeding print job, the roll-feeding print job is preferentially executed. In this way, a total print waiting time can be shortened.

According to the second embodiment, upon reception of a roll-feeding print job during the preparation for air feeding after reception of an air-feeding print job, if the number of pages to be printed by the roll-feeding print job is smaller than a prescribed value, the roll-feeding print job is preferentially executed. In this way, a total print waiting time can be shortened. On the other hand, in a case that the number of pages to be printed by the roll-feeding print job is larger than the prescribed value, since the previously received air-feeding print job is preferentially executed, the total print waiting time until completion of the air-feeding print job can be shortened.

According to the third embodiment, upon reception of a roll-feeding print job during the preparation for air feeding after reception of an air-feeding print job, if that roll-feeding print job is executed, the transmission source of the air-feeding print job is notified of a change in print order.

According to the fourth embodiment, upon reception of a roll-feeding print job during the preparation for air feeding after reception of an air-feeding print job, the roll-feeding print job is preferentially executed. If the preparation for air feeding is complete during execution of the roll-feeding print job, execution of the roll-feeding print job is interrupted, and the air-feeding print job is started, thus executing the print jobs without changing the final print order.

According to the fifth embodiment, the processing order of a print job, which designates the staple process, bookbinding process, or the like that may disturb a change in print order, can be inhibited from being changed.

According to the sixth embodiment, since different discharge destinations are used for an air-feeding print job and roll-feeding print job, the print results of different print jobs can be prevented being discharged together.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-65779, filed Mar. 14, 2007, which is hereby incorporated by reference herein in its entirety.

What is claimed is:

1. A printing apparatus comprising:

a first feeding unit configured to separate a sheet from other sheets using air and to feed the sheet;

a second feeding unit configured to feed a sheet using a roller;

an accepting unit configured to accept a first print job for printing an image on the sheet fed from the first feeding unit and a second print job for printing an image on the sheet fed from the second feeding unit;

a determination unit configured to determine whether the first feeding unit can feed the sheet existing in the first feeding unit or the first feeding unit cannot feed the sheet existing in the first feeding unit; and a control unit configured to execute, in a case where the determination unit determines that the first feeding unit cannot feed the sheet existing in the first feeding unit, the second print job accepted after accepting the first print job, prior to executing of the first print job.

2. The printing apparatus according to claim 1, wherein the control unit executes the first print job after completion of the second print job.

3. The printing apparatus according to claim 1, wherein in a case where the determination unit determines that the first feeding unit becomes to be able to feed the sheet existing in the first feeding unit before completion of the second print job, the control unit restarts the first print job before completion of the second print job.

4. The printing apparatus according to claim 1, wherein the control unit determines whether or not the second print job includes at least one of a staple designation and a bookbinding designation, and the control unit executes, prior to executing of the first print job, the second print job accepted after accepting the first print job in a case where the control unit determines that the second print job includes neither the staple designation nor the bookbinding designation.

5. The printing apparatus according to claim 1, further comprising a discharge destination designation unit designates different discharge destinations of printed sheets output by execution of the first print job and output by execution of the second print job.

6. The printing apparatus according to claim 1, wherein in a case where the number of pages to be printed by the second print job is not more than a prescribed value, the control unit executes, prior to executing of the first print job, the second print job accepted after accepting the first print job.

7. The printing apparatus according to claim 1, further comprising a notification unit configured to, in a case where the control unit executes, prior to executing of the first print job, the second print job accepted after accepting the first print job, notify an issuer of the first print job.

8. A method of controlling a printing apparatus which comprises a first feeding unit configured to separate a sheet from other sheets using air and to feed the sheet, and a second feeding unit configured to feed a sheet using a roller, the method comprises;

accepting a first print job for printing an image on the sheet fed from the first feeding unit and a second print job for printing an image on the sheet fed from the second feeding unit;

determining whether the first feeding unit can feed the sheet existing in the first feeding unit or the first feeding unit cannot feed the sheet existing in the first feeding unit; and executing, in a case where it is determined that the first feeding unit cannot feed the sheet existing in the first feeding unit, the second print job accepted after accepting the first print job, prior to executing of the first print job.

9. A non-transitory computer-readable medium storing a computer program for causing a computer to execute a method for controlling a printing apparatus which comprises a first feeding unit configured to separate a sheet from other sheets using air and to feed the sheet, and a second feeding unit configured to feed a sheet using a roller, the computer program comprises;

a code to accept a first print job for printing an image on the sheet fed from the first feeding unit and a second print job for printing an image on the sheet fed from the second feeding unit;

a code to determine whether the first feeding unit can feed the sheet existing in the first feeding unit or the first feeding unit cannot feed the sheet existing in the first feeding unit; and a code to execute, in a case where it is determined that the first feeding unit cannot feed the sheet existing in the first feeding unit, the second print job accepted after accepting the first print job, prior to executing of the first print job.

* * * * *